US005951933A

United States Patent [19]

Stall et al.

[11] Patent Number: 5,951,933

[45] **Date of Patent: *Sep. 14, 1999**

[54] PROCESSES FOR PRECIPITATING TERTIARY AMINE OXIDE CELLULOSE SOLUTIONS CONTAINING WATER SOLUBLE POLYMERS AND PRODUCTS MADE THEREFROM

[75] Inventors: Alan David Stall, Naperville, Ill.; Albin F. Turbak, Sandy Springs, Ga.

[73] Assignee: Alfacel s.a., Madrid, Spain

[ * ] Notice: This patent is subject to a terminal disclaimer.

[21] Appl. No.: 08/899,684

[22] Filed: Jul. 24, 1997

[51] Int. Cl.[6] ..... D01F 1/10; D01F 2/02

[52] U.S. Cl. ..... 264/187; 264/203; 536/56; 536/57

[58] Field of Search ..... 536/56, 57, 124; 264/187, 203

[56] References Cited

U.S. PATENT DOCUMENTS

| | | | |
|---|---|---|---|
| 2,179,181 | 11/1939 | Graenacher et al. | 106/40 |
| 3,447,939 | 6/1969 | Johnson | 106/135 |
| 3,508,941 | 4/1970 | Johnson | 106/125 |
| 4,142,913 | 3/1979 | McCorsley, III et al. | 106/186 |
| 4,144,080 | 3/1979 | McCorsley, III | 106/186 |
| 4,145,532 | 3/1979 | Franks et al. | 536/56 |
| 4,426,288 | 1/1984 | Miinte | 210/242.3 |
| 5,358,765 | 10/1994 | Markulin | 428/34.8 |
| 5,891,375 | 4/1999 | Stall et al. | 264/187 |

OTHER PUBLICATIONS

Chanzy et al., "Swelling and Dissolution of Cellulose in Amine Oxide/Water Systems," *Journal of Applied Polymer Science: Applied Polymer Symposium*, 37:239–259 (1983).

Turbak et al., "Cellulose solvents," *Chemtech*, 10:51–57 (Jan., 1980).

Turbak, A.F., "Recent developments in cellulose solvent systems," *TAPPI Journal*, 67(1):94–96 (Jan., 1984).

*Primary Examiner*—James O. Wilson
*Assistant Examiner*—Howard Owens
*Attorney, Agent, or Firm*—Marshall, O'Toole, Gerstein, Murray & Borun

[57] ABSTRACT

The invention provides improvements in processes for film and fiber production involving precipitating cellulose from tertiary amine oxide solutions wherein a water soluble polymer is incorporated into the solution in an amount sufficient to slow precipitation of the cellulose during separation of the cellulose from the tertiary amine oxide.

21 Claims, No Drawings

PROCESSES FOR PRECIPITATING TERTIARY AMINE OXIDE CELLULOSE SOLUTIONS CONTAINING WATER SOLUBLE POLYMERS AND PRODUCTS MADE THEREFROM

BACKGROUND OF THE INVENTION

The present invention relates generally to regenerated cellulose and more specifically to processes for preparing solutions of cellulose in a tertiary amine oxide and for producing shaped articles such as fibers and films.

The use of organic N-oxides such as tertiary amine oxides for dissolving cellulose was first reported by Graenacher and Sallman in U.S. Pat. No. 2,179,181. Subsequently, the specific use of N-Methyl Morpholine-N-Oxide (NMMO) to dissolve cellulose was disclosed by D. L. Johnson in U.S. Pat. No. 3,447,939 and U.S. Pat. No. 3,508,941. These patents disclose the use of NMMO to dissolve cellulose and the production of films and fibers by the precipitation of the dissolved cellulose.

The use of NMMO as a solvent for cellulose and the production of cellulosic fibers and films was also disclosed in McCorsley et al., U.S. Pat. No. 4,142,913 which disclose a process wherein cellulose is mixed with a tertiary amine oxide such as NMMO and a liquid non-solvent containing controlled amounts of water which assists in intimately associating the tertiary amine oxide with the fibers of the cellulose to facilitate absorption of the tertiary amine oxide. The resulting mixture is maintained at a temperature at which the non-solvent and excess water are removed so that the cellulose dissolves in the tertiary amine oxide until a solution is obtained which is suitable for shaping into a cellulosic article such as by spinning or extrusion. The non-solvent can be water or it can be a mixture of water and organic non-solvent with a boiling point below 130° C. including alcohols such as n-propyl alcohol, isopropyl alcohol, butanol or an aprotic liquid such as toluene, morpholine, methyl ethyl ketone or tetrahydrofuran.

McCorsley et al., U.S. Pat. No. 4,144,080 disclose a process wherein a comminuted solid precursor of a solution of cellulose in amine oxide such as NMMO is charged to an extrusion apparatus, is heated to a temperature where the amine oxide dissolves the cellulose to form an extrudable solution of cellulose and the resulting solution is extruded through a die to form an extrudate of uniform composition. Franks et al., U.S. Pat. No. 4,145,532 disclose methods of dissolving cellulose in solutions containing water and NMMO. Turbak et al., *Chemtech*, p. 51–57, January, 1980 provide a review of developments in cellulose solvent systems including amine oxides. Turbak subsequently reported cellulose solutions with lithium chloride and dimethylacetamide. These references further describe the potential use of such solutions in the production of new fiber and film products.

Of specific interest to the present application is the disclosure of Johnson, U.S. Pat. No. 3,508,941 which describes the addition of various water soluble and other polymers including polymeric esters such as poly(vinyl acetate), polysaccharides such as gum arabic, and proteins such as gelatin with cellulose and uses dimethyl sulfoxide (DMSO) as an organic co-solvent for the two polymers in the presence of N-methyl-morpholine-N-oxide and other cyclic N-oxides. Nevertheless, U.S. Pat. No. 3,508,941 teaches in its examples use of at least equal amounts of the added polymer to the amount of cellulose and does not disclose use of water as a cosolvent with lowering the water concentration to a point necessary to achieve solubility of the cellulose.

The NMMO process for producing cellulosic fibers and films has become particularly attractive in recent years because of safety and environmental concerns regarding the viscose process traditionally used for production of cellulosic films and fibers. In particular, the use of carbon disulfide in the viscose system has led to a desire for a simple, more ecologically friendly closed loop totally recoverable cellulose solvent system. Use of processes for spinning cellulose from NMMO solutions continues with the manufacture of over 120 million lbs/year of cellulose fibers via the NMMO process in about 1996.

While the NMMO system for production of cellulosic films and fibers provides various benefits over use of the viscose system it is also subject to certain limitations. This is particularly the case with respect to the ability to control the precipitation of the cellulose. In the viscose system, the cellulose is first made into a xanthate derivative by the use of caustic soda and carbon disulfide. This derivative is then spun into a coagulation/regeneration bath containing high salt and low to medium acid so that the cellulose can first be congealed into a gelatinous mass and densified by the salt in a controlled manner. This allows the xanthate solubilizing groups on the cellulose molecules sufficient opportunity to permit alignment and packing of the cellulose into the proper positions to make a good quality product. The longer the regeneration is retarded, the higher is the resulting product quality since more effective stretching and alignment can be obtained in the densifying coagulated system.

In contrast to methods of using the viscose system, the cellulose molecules in tertiary amine oxide processes are not derivatized but are directly dissolved by the action of the tertiary amine oxide. This dissolving takes place over very narrow limits of water content. As may be seen from the graphs published by Franks et al. in U.S. Pat. No. 4,145,532 and also by Chanzy et al. "Swelling and Dissolution of Cellulose in Amine Oxide/Water Systems," *Ninth Cellulose Conference*, State University of New York, Syracuse, N.Y., May 24–27, 1982) there are relatively narrow concentration ranges for dissolving and maintaining cellulose in solution. Beyond these ranges, for example, further addition of water causes very rapid and drastic precipitation of the cellulose out of solution. See also, Turbak, *TAPPI Journal*, Vol. 67., No. 1 pp. 94–96 (1984). Thus, as compared to the viscose process, the ability to control the coagulation and precipitation of cellulose in a tertiary amine oxide process is substantially diminished thus hindering the ability to provide for orderly spinning of a fiber or extrusion of a film. While such rapid and dramatic precipitation is advantageous from the view of getting high spinning speeds, it is disadvantageous with respect to being able to control and improve the nature of the product properties. Accordingly, there exists a need in the art for methods to retard and control the rapid precipitation of the cellulose from NMMO and other tertiary amine oxide solutions in order that better control of molecular structure can be obtained during the coagulation and precipitation of the cellulose molecules.

SUMMARY OF THE INVENTION

The present invention provides improved methods for slowing and controlling the rapid precipitation of cellulose from tertiary amine oxide solutions. Specifically, it has been found that selected water soluble polymers added to the NMMO cellulose solutions can act as buffers to dramatically diminish the "activity" of the water and slow the precipitation process.

Specifically, the invention provides the use of water soluble polymers as additives to cellulose/tertiary amine oxide solutions to retard the rapid precipitation of said cellulose/tertiary amine oxide solutions on spinning or extrusion into water. The invention thus provides improvements in a process for precipitating cellulose from a solution thereof which comprises dissolving cellulose in a solvent for the cellulose containing a tertiary amine oxide and thereafter shaping the solution and separating the cellulose from the tertiary amine oxide, the improvement wherein the solution comprises a water soluble polymer in an amount sufficient to retard precipitation of the cellulose during separation of the cellulose from the tertiary amine oxide. According to preferred embodiments of the invention the solution comprises from 8% to 28% water and the water soluble polymers are present in the solution in amounts between 2% and 40% by weight based on the cellulose. The precipitation preferably takes place in an aqueous system precipitation bath which can be cold or hot water or even steam. According to a preferred aspect of the invention, the solution is substantially free of an organic cosolvent for the water soluble polymer (such as DMSO). The process may be used to provide fibers, films and other materials including sausage casings because of the improved processability of the precipitating cellulose provided by the methods of the invention.

While the tertiary amine oxide can be any of a variety known to the art including N-methylpiperidine-N-oxide; N-methylhomopiperidine oxide; N-dimethylcyclohexylamine oxide; N,N-dimethybenzylamine oxide; N-methylpyrrolidone-oxide the preferred tertiary amine oxide according to the invention is N-methyl morpholine N-oxide (NMMO).

Water soluble polymers useful according to the methods of the invention include those selected from the group consisting of polysaccharides, modified cellulose, derivatized cellulose, proteins and synthetic water soluble polymers such as polyethers, polyvinyl alcohols and polyacrylates. As used herein "water soluble polymer" includes water soluble and water swellable polymers. More specifically, polymers will be considered "water soluble" if when added to distilled water at a 1% by weight concentration they raise the Brookfield viscosity of the water to 50 centipoise or greater at 25° C. at 30 rpm. Suitable polysaccharides include natural sugar polymers and modified sugar polymers and derivatized sugar polymers including sulfated sugar polymers and also include gums such as carrageenan, alginic acid, xanthan gum, locust bean gum, guar gum, agar, acacia gum and the like. Suitable water soluble proteins include gelatin. Modified and/or derivatized cellulose polymers include carboxymethyl cellulose, hydroxypropyl cellulose, methyl cellulose and the like.

According to a particularly preferred embodiment of the invention, polyethers may be employed as the water soluble polymer. Polyethers particularly preferred for use according to the invention include those having a molecular weight greater than or equal to 50,000. Particularly preferred polyethers including poly(ethylene oxide) polymers having molecular weights of 100,000 (POLYOX WRSN-10, Union Carbide), of 900,000 (Polyox WSR-1105, Union Carbide), of 4,000,000 (POLYOX WSR-1105, Union Carbide) and a methyl capped polypropylene oxide polymer having a molecular weight of 50,000. According to a particularly preferred aspect of the invention the solution comprises from about 5% to about 35% cellulose; and from about 0.1 to about 14% of a polyether having a molecular weight of greater than or equal to 50,000 dissolved in a solvent containing from about 72% to 92% NMMO and 8% to 28% water.

Those of skill in the art upon considering the disclosure herein would be able to determine the concentration of water soluble polymer required to be incorporated into the cellulose/tertiary amine oxide solutions in order to prolong and better control the precipitation of cellulose. Nevertheless, it is generally preferred that the water soluble polymer be present in amounts above 2% by weight based on the cellulose. It is further preferred that the water soluble polymer be present in a concentration of less than 50% by weight and more preferably less than 25% by weight based on the cellulose. In the case of polyethers it is generally preferred that the polyether be present in amounts above 0.5% by weight based on the final solution.

The solutions used according to the invention may also comprise other ingredients known to be useful in tertiary amine oxide/cellulose solutions. Nevertheless, additives having free hydroxyl groups are generally detrimental to achieving cellulose solution in the NMMO, all such additives may require additional NMMO for their separate dissolution prior to being admixed with the cellulose NMMO solution.

The solutions may optionally incorporate di- tri and multiple esters as described in co-owned and copending U.S. Ser. No. 08/899,425 filed simultaneously herewith, wherein the disclosure is incorporated herein by reference. Preferred esters include glycerol diesters, and glycerol triesters including glycerol trioleate, glycerol monooleate diacetate, glycerol triacetate, as well as ethylene and propylene glycol fatty acid esters, lecithin, and citric acid esters. Also incorporated by reference herein is the disclosure of co-owned and copending U.S. Ser. No. 08/899,538 filed simultaneously herewith which describes improved methods for retarding and controlling the rapid precipitation of cellulose from tertiary amine oxide solutions in aqueous hardening baths by reducing the concentration of water therein and preferably increasing the concentration of tertiary amine oxides in the stead of the water therein.

The methods of the invention provide the opportunity to more effectively control the precipitation of cellulose from systems using solutions of cellulose and tertiary amine oxides. The greater control in precipitation afforded by practice of the methods of the invention provides improvements in methods for precipitation of cellulose to form fibers as well as to form films.

DETAILED DESCRIPTION

The present invention provides improved methods for slowing and controlling the rapid precipitation of cellulose from solutions of tertiary amine oxides generally and NMMO solutions in particular. Specifically, it has been found that selected water soluble polymers added to the NMMO cellulose solutions can act as buffers to dramatically slow down the precipitation process. While the exact mechanism by which these compounds act in a beneficial manner is not known, it is believed that these materials might intercept the incoming water molecules and tie them up for a short period so that they cannot rapidly upset the critical balance of NMMO/water/cellulose ratio needed to keep the cellulose molecules in solution.

The methods of the invention thus provide an important improvement in processing of tertiary amine oxide/cellulose solutions and their conversion into fibers, films, sausage casings and other formed goods. By using this technology, not only can the present products be improved, but new product properties can be provided due to the inclusion of these described additives in the resulting products.

Other aspects and advantages of the present invention will be understood upon consideration of the following illustrative and comparative examples.

EXAMPLE 1

According to this example, an approximately 10% solution of cellulose is prepared in N-methyl morpholine-N-oxide (NMMO) according to the general methods described in U.S. Pat. Nos. 3,447,939; 4,145,532; 4,426,288; 4,142,913; 4,144,080 and 4,145,532. The cellulose is first premixed with the desired additive before the addition of the NMMO and the subsequent removal of excess water to form the cellulose solution. In a typical run, 10 parts of cellulose is added to 80 parts of water containing 2 parts of dissolved sodium carboxymethyl cellulose (CMC), a water soluble polymer of 50,000 molecular weight. Since the coagulating water must be concentrated and recycled to save the NMMO, one of the reasons for using water soluble polymers having a molecular weight of more than 10,000 is to be sure that none of the relatively water soluble polymer will dissolve out of the film and contaminate the coagulating water. The system is mixed thoroughly to allow good intermixing of cellulose and CMC. To this mixture is then added 76 parts of NMMO and the mixture is placed in a sigma blade high torque mixer under vacuum. The mixing system is heated up to no more than 120° C. while vacuum is continued and excess water is removed. (Safety note: 120° C. is chosen since NMMO is known to explode violently at or above 140° C.). When the active water level in the mixture reaches less than about 27% of the weight of the NMMO, preferably from 8%–15% the weight of the NMMO, both the cellulose and CMC are in solution. At the 15% weight of NMMO water level, this gives a solution containing essentially 10% by weight of cellulose, 2% by weight of CMC dissolved in 76.4% of NMMO containing 11.5% of water. This solution containing about 20% by weight of CMC based on the cellulose is then pumped to a screw feeder extruder, deaerated and extruded into the desired shape into an aqueous system precipitation bath. The precipitation bath can be cold or warm water or even steam. Regardless of the nature of the precipitation aqueous system, the rate of precipitation of the cellulose is significantly retarded and the extrudate can be subjected to more stretch and congealing than is possible if the additive is absent.

If the above bath is spun into fibers, the fibers having the added time for stretching are at least 15% stronger than controls run without the additive. If the above NMMO solution is spun into a film, the film, if properly stretched, is at least 15% more strength in both the machine and transverse direction. The improvement in properties is found in fibers, films and sausage casings.

EXAMPLE 2

According to this example, the method of Example 1 is repeated except that 1 part of carrageenan (a sulfated sugar water soluble polymer obtained from seaweeds) having a molecular weight of 600,000 is used in place of the 2 parts of the CMC to give a final solution having only about 1% of carrageenan. This solution also exhibits retarded precipitation when spun into water and the product has superior strength and elongation properties as compared to a control with no additive. Sausage casings from this run exhibit superior burst and strength properties. Fiber from this run exhibit improved elongation, strength and toughness.

EXAMPLE 3

According to this example, the method of Example 2 is repeated but 3.0 parts of polyvinyl alcohol having over 80% available (OH) groups and having a molecular weight of 30,000 is added in place of the 1 part of carrageenan to give a final solution having 3% polyvinyl alcohol based on the cellulose. Similar results are obtained wherein the cellulose NMMO solution having the added polyvinyl alcohol gives superior products as compared to the control. Sausage casings and fibers so made exhibit results similar to those of Example 2.

EXAMPLE 4

According to this example, the method of Example 1 is repeated except that 0.2 parts of sodium polyacrylate having a molecular weight of 190,000 is used in place of the 2 parts of CMC giving a solution having about 2% of the acrylate polymer based on cellulose. Similar improvements in retarding precipitation and in improved process and product properties are noted.

EXAMPLE 5

According to this example, the method of Example 1 is repeated except that 1 part of pectic acid having a molecular weight of 170,000 is added to the N-methyl morpholine-N-oxide in place of the 2 parts of CMC, giving a solution having 10% pectic acid based on the cellulose. A significant retardation of precipitation is observed and significant improvements in product strength, elongation, toughness and burst are noted.

EXAMPLE 6

According to this example, the method of Example 1 is repeated but 2 parts of alginic acid is added in place of the 2 parts of CMC. A significant retardation of precipitation is observed and the products exhibit improved toughness and burst properties as compared to control without any additives.

EXAMPLE 7

According to this example, the method of Example 1 is repeated except that 3 parts of gelatin having a molecular weight of about 50,000 is added to the N-methyl morpholine-N-oxide in place of the 2 parts of CMC, giving a solution having 30% gelatin based on the cellulose. A significant retardation of precipitation and significant improvements in product strength, elongation, toughness and burst are noted.

EXAMPLE 8

According to this example, a 10% solution of cellulose is prepared in N-methyl morpholine-N-oxide [NMMO] according to the general method of example 1. Specifically, 10 parts of cellulose is added to 150 parts of water containing 2 parts of dissolved POLYOX WRSN-10 (a water soluble polyether of 100,000 molecular weight available from Union Carbide Co.). Since the coagulating water must be concentrated and recycled to save the NMMO, one of the reasons for using polyox compounds having a molecular weight of more than 70,000 is to ensure that none of the relatively water soluble polyether will dissolve out of the firm and contaminate the coagulating water. The system is mixed thoroughly to allow good intermixing of cellulose and polyox. To this mixture is then added 76 parts of NMMO and the mixture is placed in a sigma blade high torque mixer under vacuum. The mixing system is heated up to no more than 120° C. while vacuum is continued and excess water is removed. (Safety note: 120° C. is chosen since NMMO is known to explode violently at, or above, 140° C.) When the water level in the mixture reaches 15% of the weight of the NMMO, the cellulose is in solution as also is the POLYOX WRSN-10. This then gives the solution containing essentially 10% by weight of cellulose, 2% by weight of polyox dissolved in 76% of NMMO containing 12% of water.

The cellulose solution is then pumped to a screw feeder extruder, deareated and extruded into the desired shape into an aqueous system precipitation bath which can be cold or warm water or even steam. Regardless of the nature of the precipitation aqueous system, incorporation of the polyether component into the solution decreases the rate of precipitation of the cellulose. In this manner the extrudate can be subjected to more stretch and congealing than is possible if the additive is absent.

If the above bath is spun into fibers, the fibers having the added time for stretching are at least 15% stronger than controls run without the additive. If the above NMMO solution is spun into a film, the film, if properly stretched, has at least 15% more strength in both the machine and transverse direction. The improvement in properties is found in fibers, films and sausage casings.

EXAMPLE 9

According to this example, the method of example 8 is repeated except that 1 part of POLYOX WSR-1105 (a 900,000 molecular weight poly(ethylene oxide, Union Carbide) is used in place of the 2 parts of the POLYOX WRSN-10 to give a final solution having only 1% by weight of the polyox. This solution also exhibits retarded precipitation when spun into water and the products have superior strength and elongation properties as compared to control with no additive. Sausage casings from this run have superior burst and strength properties. Fiber from this run have improved elongation, strength and toughness.

EXAMPLE 10

According to this example, the method of example 9 is repeated but 0.5 parts of POLYOX WSR-301 (Union Carbide) having a molecular weight of 4,000,000 is added in place of the 1 part of POLYOX WSR-1105. Similar results are obtained wherein the cellulose NMMO solution having the added polyox gives superior products as compared to control. Sausage casings and fibers so made have results similar to those for Example 2.

EXAMPLE 11

According to this example, the method of example 8 is repeated except that 2 parts of methyl capped polypropylene oxide polymer having molecular weight of 50,000 is in place of the WRSN-10 and the capped polypropylene oxide is added directly to the NMMO rather than to the water. Improvements in retarding precipitation and in improved process and product properties similar to those of example 1 are obtained.

EXAMPLE 12

According to this example, the method of example 8 is repeated except that 1 part of hydroxypropyl cellulose ether is added directly to the N-methyl morpholine-N-oxide in place of the polyox being added to the water. A significant retardation of precipitation is observed and significant improvements in product strength, elongation, toughness and burst are obtained.

EXAMPLE 13

According to this example, the method of example 12 is repeated except that 4 parts of methylcellulose ether of M.W. 90,000 is substituted for the hydroxypropyl cellulose. A significant decrease in precipitation is noted.

Numerous modifications and variations in the practice of the invention are expected to occur to those skilled in the art upon consideration of the foregoing description on the presently preferred embodiments thereof. Consequently the only limitations which should be placed upon the scope of the present invention are those that appear in the appended claims.

What is claimed is:

1. In a process for precipitating cellulose from a solution thereof which comprises dissolving cellulose in a solvent containing a tertiary amine oxide and thereafter shaping the cellulose into a cellulosic article, and separating the cellulose from the tertiary amine oxide, the improvement wherein the solution comprises water, a water soluble polymer having a molecular weight of at least 10,000 in an amount sufficient to retard precipitation of the cellulose during separation of the cellulose from the tertiary amine oxide, and is substantially free of an organic cosolvent for the water soluble polymer.

2. The process of claim 1 wherein the tertiary amine oxide is N-methyl morpholine N-oxide (NMMO).

3. The process of claim 1 wherein the precipitation takes place in an aqueous system precipitation bath.

4. The process of claim 2 where in the solution comprises from 8% to 28% water.

5. The process of claim 1 wherein the water soluble polymer is present in the solution in amounts between 2% and 40% by weight based on the cellulose.

6. The process of claim 1 wherein the water soluble polymer is selected from the group consisting of polysaccharides, modified cellulose, derivatized cellulose, proteins and polyethers.

7. The process of claim 1 wherein the water soluble polymer is a gum.

8. The process of claim 1 wherein the water soluble polymer is a carboxylated cellulose derivative.

9. The process of claim 1 wherein the water soluble polymer is a derivatized sugar polymer.

10. The process of claim 1 wherein the water soluble polymer is a sulfated sugar polymer.

11. The process of claim 1 wherein the water soluble polymer is a polyacrylic acid having at least 50% unesterified carboxyl groups.

12. The process of claim 1 wherein the water soluble polymer is a polyacrylic acid copolymer having at least 50% acrylic acid groups.

13. The process of claim 1 wherein the water soluble polymer is a protein.

14. The process of claim 1 wherein the water soluble polymer is a polyether.

15. The process of claim 4 wherein the polyether is present in amounts above 0.5% by weight based on the cellulose.

16. The process of claim 14 wherein the polyether is poly(ethylene oxide) polymers having molecular weights of at least 100,000.

17. The process of claim 16 wherein the polyether has a molecular weight of at least 900,000.

18. The process of claim 14 wherein the polyether is a methyl capped polypropylene oxide polymer.

19. The process of claim 14 wherein the solution comprises from about 5% to about 35% cellulose; and from about 0.1 to about 4% of a polyether having a molecular weight of greater than or equal to 50,000 dissolved in a solvent containing from about 72% to 90% NMMO and 10% to 28% water.

20. The process of claim 1 wherein the cellulose is precipitated to form a fiber.

21. The process of claim 1 wherein the cellulose is precipitated to form a film.

* * * * *